United States Patent [19]

Pongratz et al.

[11] Patent Number: 4,677,894

[45] Date of Patent: Jul. 7, 1987

[54] DEVICE FOR THE CENTERING RETENTION OF AMMUNITION IN AN AMMUNITION RECEIVER

[75] Inventors: Leonhard Pongratz, Karlsfeld; Ferenc Kotai; Markus Spotzl, both of Munich, all of Fed. Rep. of Germany

[73] Assignee: Krauss-Maffei A.G., Fed. Rep. of Germany

[21] Appl. No.: 919,014

[22] Filed: Oct. 15, 1986

[30] Foreign Application Priority Data

Oct. 15, 1985 [DE] Fed. Rep. of Germany ..... 3536672

[51] Int. Cl.[4] ..... F42B 33/00

[52] U.S. Cl. ..... 86/45; 89/45; 73/167

[58] Field of Search ..... 86/45, 46; 89/33.5, 89/45; 73/167

[56] References Cited

U.S. PATENT DOCUMENTS

| | | | |
|---|---|---|---|
| 4,380,950 | 4/1983 | Renoux | 89/45 X |
| 4,425,833 | 1/1984 | Purdie | 86/46 X |
| 4,573,392 | 3/1986 | Mantel | 86/45 X |

FOREIGN PATENT DOCUMENTS

| | | | |
|---|---|---|---|
| 2826136 | 6/1981 | Fed. Rep. of Germany . | |
| 2076764 | 12/1981 | United Kingdom | 86/45 |

*Primary Examiner*—Peter A. Nelson

*Attorney, Agent, or Firm*—Robert J. Koch

[57] ABSTRACT

A device for centering retention of ammunition includes an ammunition receiver having spring elastic holding elements acting in the radially inward direction in the tapering section of the ammunition and gripping elements holding the ring of the cartridge of the ammunition arranged in the bottom area of the ammunition. The holding elements are made up of leaf springs fastened to the ammunition receiver in the direction of the generators of the ammunition in a forward and a rear clamping location in order to assure retention of the ammunition without wear in case of severe jolting movements and to assure safe transfer of the ammunition into the cartridge chamber without damaging it. Each leaf spring comprising a recess or inward protrusion acting on the ammunition in its tapering section and a free end projecting past a forward clamping location in a radially inward direction.

15 Claims, 8 Drawing Figures

DEVICE FOR THE CENTERING RETENTION OF AMMUNITION IN AN AMMUNITION RECEIVER

BACKGROUND OF THE INVENTION

1. Field of the Invention

The invention relates to a device for the centering retention of ammunition.

2. Description of the Related Art

A device is shown in DE-AS No. 28 26 136 in which ammunition is stored in a tubular ammunition receiver. The ammunition is supported at the bottom of the cartridge case by a projection gripping the rim of the case. It is further retained by elastically supporting centering rolls in the tapering zone or projectile part of the ammunition. This type of retention can cause damage to the ammunition during the transfer of the ammunition from the tubular ammunition receiver into the breach of the gun. This damage occurs if the center of gravity of the ammunition migrates or shifts forward, past the centering rolls, and the front part of the ammunition tilts away transversely to the axis of the tubular ammunition receiver, i.e., transversely to the axis of the bore of the gun, thereby impacting on the rear edge of the barrel, which for sealing purposes is usually sharp.

SUMMARY OF THE INVENTION

It is an object of the invention to provide a device for the retention of ammunition in an ammunition receiver which assures undamaged transfer of the ammunition from the ammunition receiver into the cartridge chamber of the gun and retention without wear of the ammunition in the ammunition receiver even upon severe jolting.

This object may be attained according to the invention by a device with an ammunition receiver housing a round of ammunition upon which spring elastic holding elements act in a radially inward direction on the tapered area and gripping elements hold the bottom rim of the cartridge of the ammunition. The holding elements comprise a plurality of leaf springs distributed over the circumference of the ammunition receiver and oriented in the direction of the generators of the ammunition. The leaf springs are fastened to the ammunition receiver at a forward and a rear clamping location where each leaf spring exhibits a recess or deflection between the two clamping locations acting on the ammunition on the ammunition's tapered section in the area of its projectile part. A free end of the springs may project past the forward clamping location and is directed radially inward. Advantageously, the leaf springs may be concentrated in a lower portion of the receiver in order to more efficiently counteract the forces of gravity upon centering retention of ammunition. An advantage obtained thereby is that the axis of the ammunition deviates only slightly from the axis of the ammunition receiver and the gun bore during transfer of the ammunition from the receiver into the cartridge chamber. The ammunition is additionally held by the free end of the leaf spring until the forward area of the ammunition is supported in the cartridge chamber. The return of the ammunition is assured in a similar fashion.

In a preferred embodiment the forward point of fixation or mounting of the leaf spring is a solid or fixed joint, so that the free end of the leaf spring is able to act on the ammunition with enhanced spring properties.

The rear point of fixation or mounting is appropriately a joint which includes means to equalize the length of the leaf spring upon bending. This purpose is achieved by a longitudinal slot provided in the leaf spring through which a guide pin fastened to the ammunition receiver projects. The rear end of the leaf spring is thereby slideably attached in order to compensate for deflection.

The gripping elements holding the rim of the cartridge case of the ammunition are preferably articulated onto an attachment which abuts against the bottom of the cartridge case. The attachment may be connected to the ammunition by magnet elements capable of actuation and deactivation.

To effect the translatory movement of the ammunition within the ammunition receiver, the starting device is conveniently coupled with a linear advance or displacement device.

In a particularly simple and appropriate embodiment, the ammunition receiver includes a tubular sleeve exhibiting an axially extending slot. A sliding block joined to the attachment extends through the slot. A driven spindle located outside the ammunition receiver and associated with the block serves to displace the block thereby advancing the attachment.

Rolls or rollers are arranged on the rear end of the attachment, corresponding to the angular position of the guide springs in order to reduce friction within the areas narrowed by the leaf springs.

The spring motion of the free ends of the leaf springs which elastically protrude in the radially inward direction, is limited by rope or cable shackles to avoid damage to the surface of the ammunition. Damage to the sensitive sealing elements located between the projectile part and the propellant part of the ammunition may particularly be prevented in this manner. A further advantage is that the free end of the leaf springs may be deflected only after a certain prestress has been overcome, whereby ammunitions exhibiting the different weights and centers of gravity may be equally centered into or out of the loading chamber of the barrel of the weapon.

In an advantageous embodiment the ammunition receiver may exhibit a telescoping inner tubular sleeve displaceable within a sheathing tube.

To improve the retaining action, locking latches may be provided on the support structure, which expand between the carrier structure and the leaf springs when the ammunition is completely inserted in the carrier structure, thereby positively gripping the ammunition in its projectile part. The locking latches assure that the ammunition is not subjected to wear by jolting movements even in the case of severe impacts particularly during extended periods in an ammunition receiver such as a loading tube or magazine tube.

The invention will become more apparent from the embodiment described below.

DETAILED DESCRIPTION OF THE PREFERRED EMBODIMENT

Figure 1:
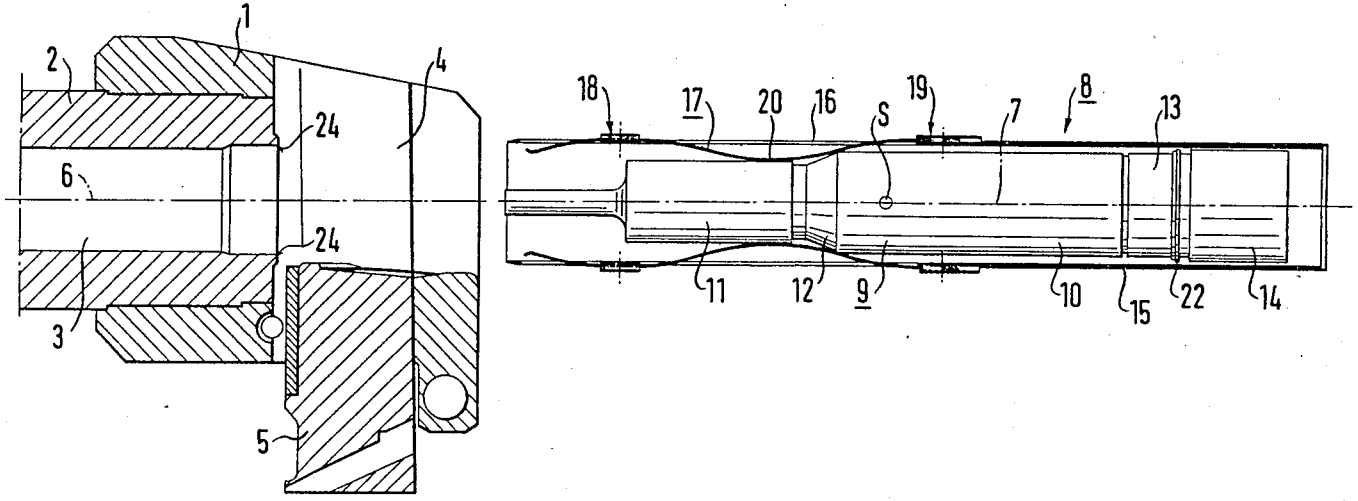
FIG. 1 shows a tubular ammunition receiver positioned in front of the breech of a gun with the ammunition completely inserted.

FIG. 1 shows a section view of the breech 1 of a gun with the end of the gun barrel 2 forming a cartridge chamber 3. The cartridge chamber 3 is followed by the breech opening 4 that may be closed by a dropping wedge 5. The axis 7 of an ammunition receiver 8 is placed aligned with the bore axis 6 of the gun barrel 2. The ammunition 9 is completely inserted in said receiver. The ammunition is made up of a propellant cartridge 10 and a projectile part 11. The propellant cartridge 10 tapers down at a transition cone 12 to the diameter of the projectile part 11. The ammunition 9 terminates at its rear end in the cartridge bottom 13 where the ammunition 9 is held by the attachment 14. The ammunition receiver 8 has a tubular sleeve 15. A plurality of leaf springs 17 are arranged in axially aligned recesses 16 in the tubular sleeves 15. The leaf springs 17 are fastened to the tubular sleeve 15 at a forward clamping location 18 and a rear clamping location 19, which permits longitudinal adjustment.

The leaf springs 17 exhibit an inwardly directed curvature 20 between the clamping locations 18 and 19 which rest on the projectile part 11 of the ammunition 9 under prestress.

The forward area of the ammunition 9 is centered in the ammunition receiver 8 by this arrangement. The rear area is centered by the gripping elements 21 (FIG. 5) articulated onto the attachment 14. The gripping elements hold the rim 22 of the propellant cartridge 10.

Figure 2:
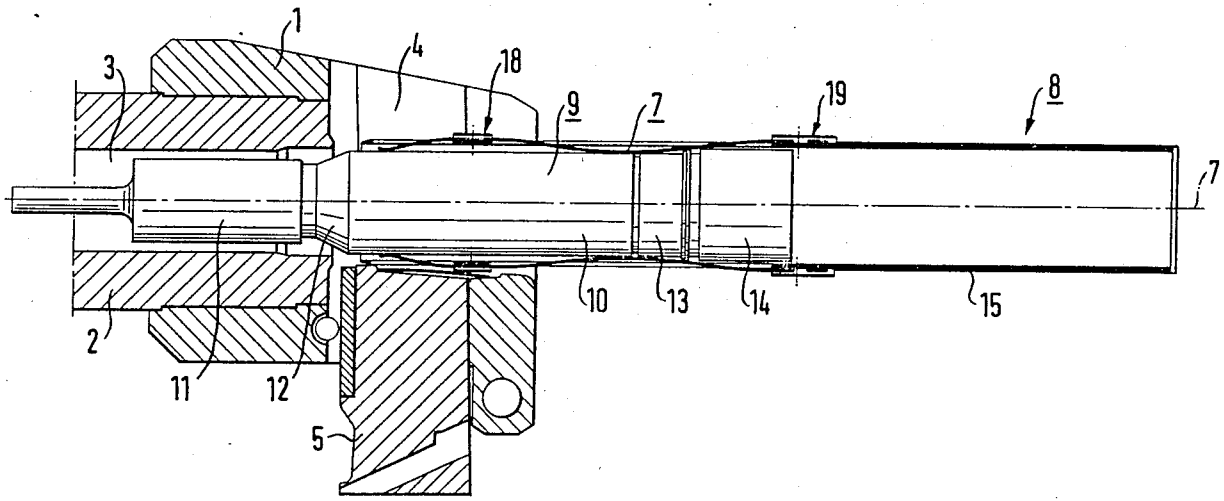
FIG. 2 shows the ammunition receiver inserted into the breech opening of the gun with the ammunition inserted partially into the cartridge chamber of the gun.

In FIG. 2 the ammunition receiver 8 is located with its forward end in the breech opening 4 and the ammunition 9 in a partially extracted position. The projectile part 11 is located in the cartridge chamber 3 of the gun barrel 2. The ammunition 9 is supported by the free ends 23 (FIG. 3) of the leaf springs 17. The centering retention of the rear part of the ammunition 9 is maintained by the gripping elements 21 of the attachment 14. The recesses 20 of the leaf springs 17 also contribute to assure that the axis of the ammunition 9 does not deviate appreciably from the axis 7 of the ammunition receiver 8 and the bore axis 6 of the gun barrel 2 during transfer from the ammunition receiver 8 to the cartridge chamber 3. This largely prevents tilting of the ammunition 9 and the consequence of impacting the sensitive propellant cartridge 10 or the transition cone 12 of the ammunition on the sharp edge of the opening rim 24 of the cartridge chamber 3 even in the event of high accelerations acting transversely to the bore axis and the axis 7 of the ammunition receiver 9.

Figure 3:
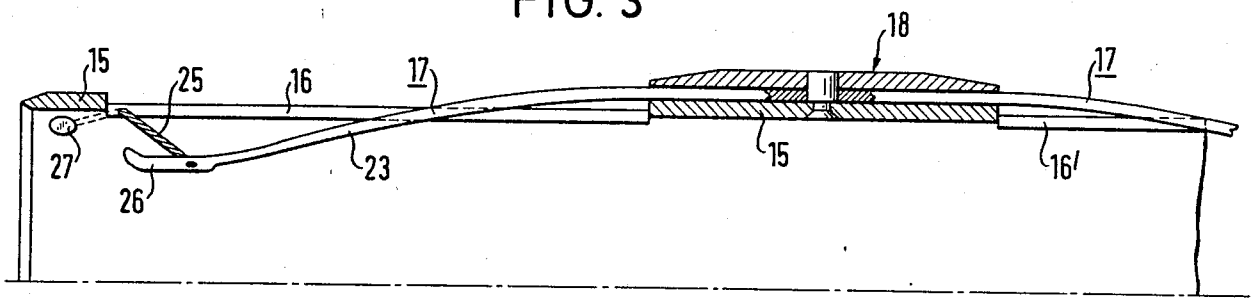
FIG. 3 shows a partial view of the ammunition receiver at a larger scale with a free end of the leaf spring and a stationary clamping location.

FIG. 3 shows a forward part of the tubular sleeve 15 of the ammunition receiver 8. The free end 23 of the leaf spring 17 is fixed by a rivet at the forward clamping location 18. The free end of the leaf spring extends through a forward portion of recess 16 and is elastically bent radially inward. The spring path is limited by a steel rope or cable 25 which is looped through openings in the tip 26 of the leaf spring and anchored on both sides of tubular sleeve 15 by rope fittings 27. The curvature 20 of the leaf springs 17 projects radially inward through a rearranged portion 16' of the recess.

Figure 4:
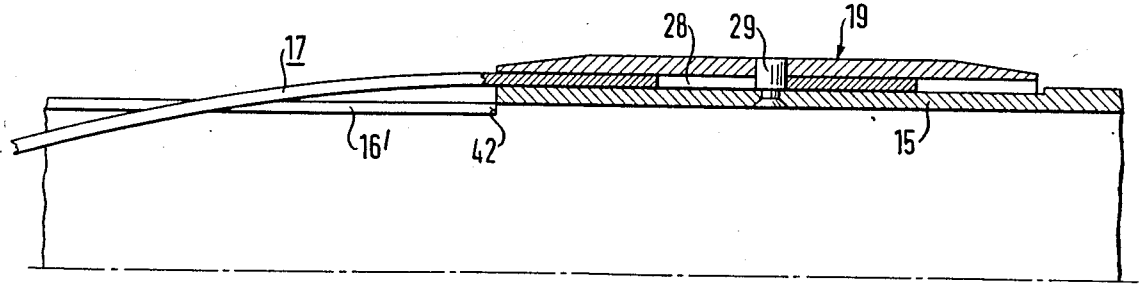
FIG. 4 shows a partial view of the ammunition receiver at a larger scale with a displaceably supported end of a leaf spring.

FIG. 4 shows the rear clamping location 19 of the leaf springs 17. A guide pin 29 which fixedly rivets the leaf spring to the tubular sleeve 15 protrudes through an elongated slot 28 in the leaf spring. The leaf spring 17 is slidingly supported at the clamping location 19 in order to permit longitudinal displacement. The spring projects radially inward through the recess 16'. The rearward portion of the recess 16' closes the opening rim 42.

Figure 5:
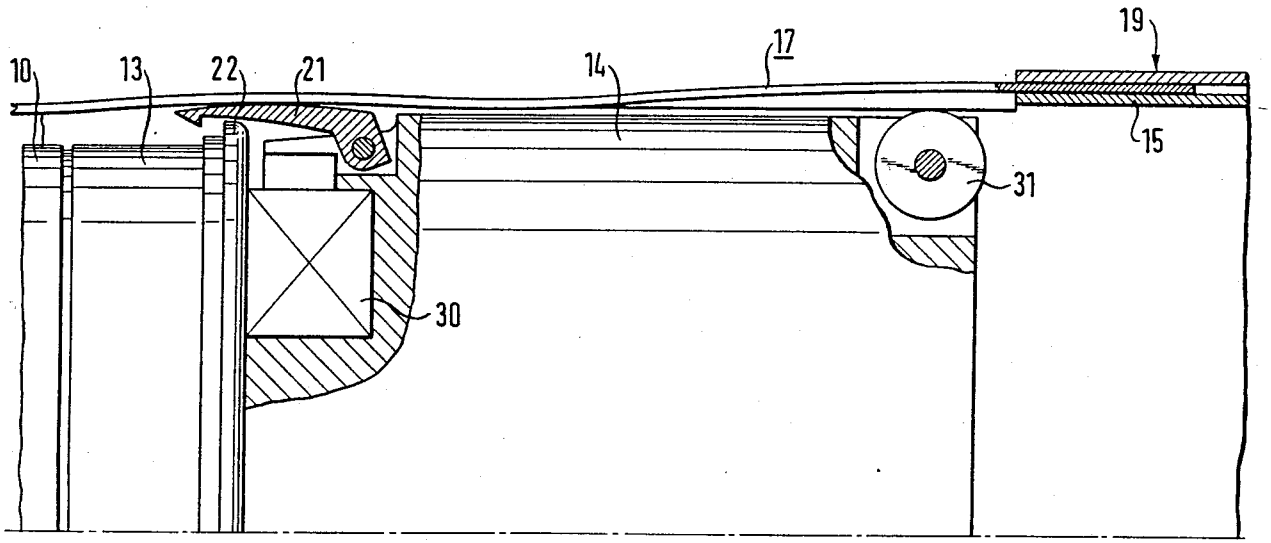
FIG. 5 shows a partial view of an attachment in an enlarged scale.

FIG. 5 shows details of the attachment 14 represented schematically only in FIGS. 1 and 2. It includes a magnetic element 30 for coupling the attachment with the ammunition 9 on an end facing the bottom of the cartridge 13. Gripping elements 21 are further articulated onto this end of the attachment 14. The attachment 14 may thereby be mechanically locked to the ammunition 9 with a centering action. Rolls 31 are located on the rear end of the attachment 14. During the movement of the attachment inside the tubular sleeve 15 the rolls 31 serve to reduce frictional resistance and wear on the leaf springs 17 during the spreading of the leaf springs 17.

Figure 6:
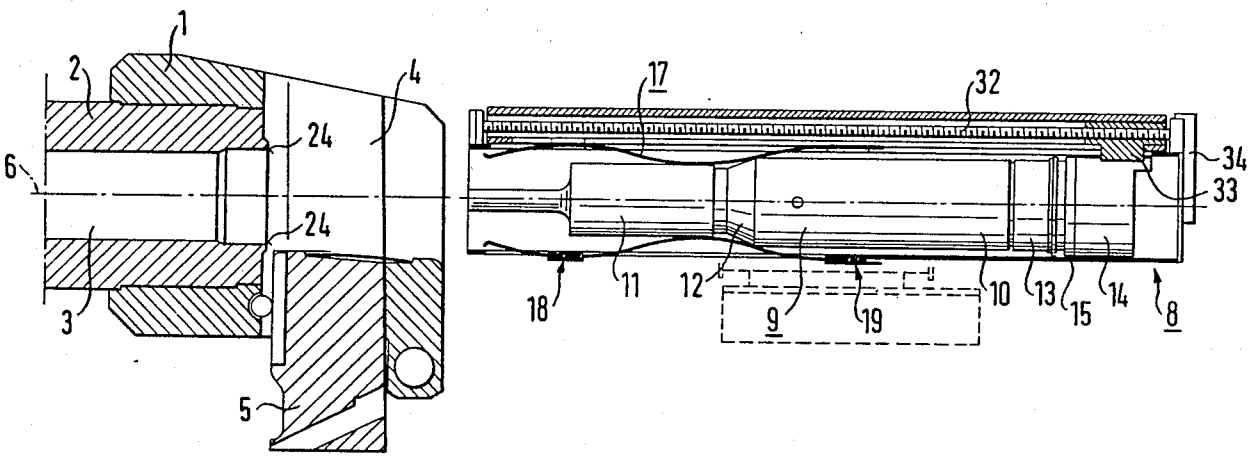
FIG. 6 shows an ammunition receiver with a spindle drive coupled to the attachment.

FIG. 6 shows a preferred embodiment of a linear advance for the attachment 14 wherein the transport effect is achieved by a spindle 32 located outside the tubular sleeve 15. The spindle is connected to the attachment by a sliding block 33. In this embodiment the tubular sleeve 15 exhibits a slot extending in the direction of the spindle. The spindle 32 may be actuated by a drive unit 34 located on the tubular sleeve 15.

The ammunition receiver 8 is equipped with devices (not shown), whereby it may be moved in the breech opening 4 of the gun. These devices may be, for example, rails upon which the ammunition receiver 8 may be guided on rollers.

In a further embodiment the devices for the longitudinal motion may include a sheathing tube (for example according to FIG. 7), wherein the tubular ammunition receiver is telescopically displaceable.

Figure 7:
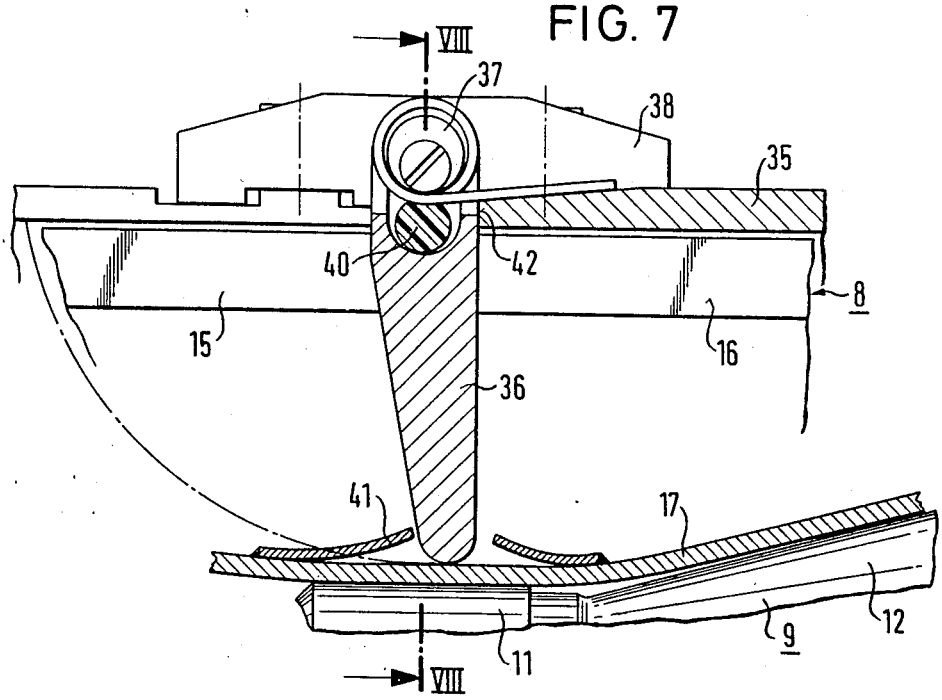
FIG. 7 shows a partial view of a locking latch articulated onto the ammunition receiver.
Figure 8:
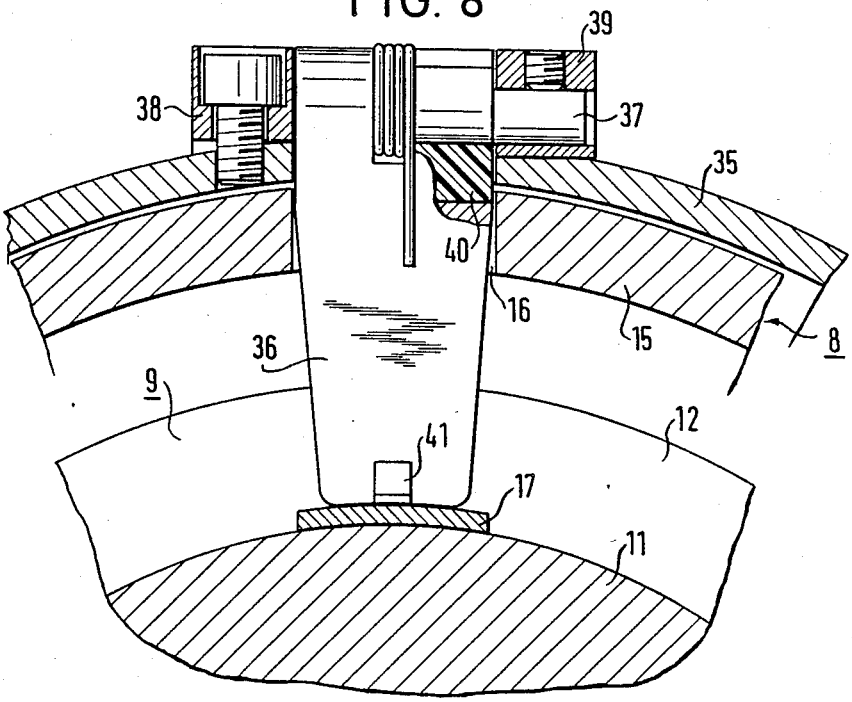
FIG. 8 shows a partial view along the section line VIII—VIII in FIG. 7.

FIGS. 7 and 8 show a partial section of an ammunition receiver 8 with a tubular sleeve 15, supported in a telescopically displaceable manner within a sheathing tube 35. A locking latch 36 is located in said sheathing tube 35. The latch 36 protrudes through the recess 16 of the ammunition receiver 8 and presses elastically against the outside of the leaf spring 17. The locking latch 36 pivots radially inward until it comes to rest in the completely inserted state of the tubular sleeve 15 on the leaf 17 in the area of its maximum radial recess 20 upon the insertion of the tubular sleeve 15 into the sheathing tube 35 thereby holding the ammunition 9, at its projectile part 11, in a locked position.

The locking latch 36 is supported on the sheathing tube 35 on two bearing blocks 38, 39, by an eccentric shaft 37 to enable the radial position of the locking latch 36 to be varied. The locking latch 36 has an elastic pad 40 on its bearing bore whereby the locking latch 36 rests under prestress and a damping effect in its locking position perpendicular to the axis of the ammunition.

The pivoting of the locking latch 36 past its radial dead point position into the locking position shown in FIG. 7 is supported by a catch 41 fastened to the leaf spring 17. The catch 41 may be arranged to prevent over pivoting of the locking latch 36.

In order to unlock the assembly, initially the carrier structure 8 is moved forward together with the leaf spring and the ammunition 9 with respect to the sheathing tube 35, whereby the locking latch is released from its locking position and pivoted into an angular position wherein it may be deflected in keeping with the radial forward motion of the leaf spring 17.

Following this unlocking phase the ammunition 9 is pushed out of the carrier structure 8 by the attachment 14.

The number of locking latches 36 arranged on the circumference of the sheathing tube 35 corresponds to the number of the leaf springs 17 fastened to the tubular sleeve 15.

We claim:

1. A device for centering retention of ammunition comprising:

means for receiving ammunition;

means for gripping an ammunition cartridge rim associated with said means for receiving;

means for retaining ammunition in axially centered alignment within said means for receiving wherein said means for retaining comprises;

a plurality of circumferentially distributed, radially inwardly acting leaf springs arranged on said means for receiving;

means for fastening a rearward end of each leaf spring to said means for receiving at a first radial plane;

means for fastening a forward position of each leaf spring to said means for receiving at a second radial plane;

a plurality of recesses in said means for receiving between said first radial plane and said second radial plane, wherein a radially inwardly contoured portion of said leaf springs extends through said recesses;

a radially inward directed forward extension of said leaf springs wherein said forward extension extends past said second radial plane and away from said first radial plane.

2. A device according to claim 1, wherein said means for fastening a forward portion is a fixed join and said means for fastening a rearward end comprises means for compensating length variations due to deflection of said leaf springs.

3. A device according to claim 2, wherein said means for compensating length variation is characterized in that the rear clamping means comprises a guide pin fastened to said means for receiving and passing through an elongated hole located in the leaf spring.

4. A device according to claim 1, wherein said means for receiving is a tubular sleeve.

5. A device according to claim 1, further comprising attachment means for positioning ammunition axially displaceable within said means for receiving; and wherein said means for gripping are mounted on said attachment means.

6. A device according to claim 5, further comprising means for displacing said attachment means coupled to said attachment means.

7. A device according to claim 6, wherein said means for displacing comprises:

a spindle arranged outside said means for retaining;

a drive means associated with said spindle;

a sliding block passing through a lateral slot in said means for retaining coupling said spindle to said attachment means.

8. A device according to claim 6, further comprising a plurality of means for reducing friction mounted on said attachment means in the circumferential areas corresponding to angular positions of said leaf springs.

9. A device according to claim 8, wherein said means for gripping are articulated onto said attachment means and are arranged in circumferential areas of said attachment means corresponding to angular positions of said leaf springs.

10. A device according to claim 1, further comprising:

means for limiting radially inward deflection of said forward extension of said leaf spring attached to said forward extension and anchored to said means for receiving.

11. A device according to claim 1, wherein said leaf springs are arranged at narrower angular distances from each other in circumferential areas of said means for receiving supporting gravitational forces exerted due to ammunition.

12. A device according to claim 1, wherein said means for receiving comprises:

a sheathing tube;

a telescopically displaceable tubular inner sleeve within said sheathing tube;

means for circumferentially locking ammunition including a plurality of locking latches articulated on said sheathing tube in angular positions corresponding to said leaf spring, means for actuating said locking latches into a radially aligned locking position upon retraction of said inner sleeve, and means for pivoting said locking latches upon extension of said inner sleeve.

13. A device according to claim 12, wherein said means for locking further comprise a plurality of latches mounted on said leaf springs wherein said locking latches are gripped by said catches in a locking position upon the telescopic retraction of said tubular sleeve into said sheathing tube.

14. A device according to claim 13, further comprising a bearing support exhibiting an elastic element for each locking latch on said sheathing tube.

15. A device according to claim 14, further comprising an eccentric element in said bearing support of each locking latch above which said locking latches pivot.

* * * * *